United States Patent [19]

Heng et al.

[11] Patent Number: 4,878,855

[45] Date of Patent: Nov. 7, 1989

[54] ELECTRIC CONNECTION TERMINAL FOR WIRES THAT ARE NOT PRIOR-STRIPPED

[75] Inventors: Jean-Paul Heng, Lyons; André Marmonier, Bron; Etienne Briguet, Rillieux la Pape, all of France

[73] Assignee: Societe Anonyme dite: CGEE Alsthom, Perret, France

[21] Appl. No.: 235,600

[22] Filed: Aug. 24, 1988

[30] Foreign Application Priority Data

Sep. 22, 1987 [FR] France ..... 87 13069

[51] Int. Cl.[4] ..... H01R 4/24

[52] U.S. Cl. ..... 439/411; 439/275; 439/425

[58] Field of Search ..... 439/426, 425, 411–414, 439/417–419, 708, 711, 801, 811, 271–283

[56] References Cited

U.S. PATENT DOCUMENTS

| | | | |
|---|---|---|---|
| 2,758,280 | 8/1956 | More | 439/412 |
| 3,154,363 | 10/1964 | Will | 439/415 |
| 3,372,361 | 3/1968 | Wengen | 439/412 |
| 3,848,955 | 11/1974 | Lockie et al. | 339/97 R |
| 3,877,773 | 4/1975 | Doty et al. | 439/413 |
| 3,902,780 | 9/1975 | Dola | 439/411 |
| 4,734,061 | 3/1988 | Randall, Jr. et al. | 439/801 |

FOREIGN PATENT DOCUMENTS

| | | | |
|---|---|---|---|
| 612213 | 11/1948 | United Kingdom . | |
| 0691802 | 5/1953 | United Kingdom | 439/418 |

*Primary Examiner*—David Pirlot

*Attorney, Agent, or Firm*—Sughrue, Mion, Zinn, Macpeak & Seas

[57] ABSTRACT

An electrical connection terminal for power transporting wires of the type comprising a multi-strand central conductor covered with insulation. The terminal comprises a rigid body (4) having threaded or tapped tubular ends each of which has at least one wire passing opening (7) passing at least partially transversely therethrough and elongate in shape parallel to the longitudinal axis of the terminal. A stopper (6) is screwed onto each tubular end and has a pusher (12) which penetrates into the tubular end to an ever increasing extent as the stopper is screwed thereon. A conducting spike (9) has perforating end points projecting from a common wall (8) through the bottoms of respective ones of the wire passing openings (7) of the tubular ends in order to enable wires inserted into the terminal through said ends to be interconnected by the spike.

7 Claims, 3 Drawing Sheets

ELECTRIC CONNECTION TERMINAL FOR WIRES THAT ARE NOT PRIOR-STRIPPED

The invention relates to electrical connection terminals for power transport wires of the type comprising a multi-strand central conductor covered in insulation, said terminal not requiring the wires to be stripped.

BACKGROUND OF THE INVENTION

A known way of connecting electrical power transport cables to each other makes use of terminals each comprising a tubular body having an end with an outside thread and provided with a blind transverse slot whose bottom constitutes a cradle arranged to receive superposed electric wires which may pass therethrough, or not.

A hollow stopper provided with an internal cylindrical pusher is screwed onto the threaded end of the tubular body.

The pusher serves to press together and thus to electrically interconnect the bare or stripped wires which are stacked in the slot between the bottom of the cradle and the pusher.

In order to electrically connect ordinary wires whose cores are covered with one or more layers of insulation, said layers must be removed from the zones of the wires which are to be received in the terminal.

The insulating layers must be removed with care in order to avoid damaging the conducting core, particularly when the core is constituted by multiple strands. Such removal is difficult to perform when the connection is to be made in the form of a tap on a wire which it is undesirable to cut in two.

Stripping the core of the wire to enable it to be connected in a terminal also suffers from the drawback of increasing the risk of inadvertent contact between said wire and apparatus or a person, in particular by virtue of the wire escaping from the terminal due to the terminal being loosened in untimely manner.

SUMMARY OF THE INVENTION

The present invention therefore provides an electrical connection terminal for power transport wires each constituted by a multi-strand conductor within insulation. The terminal comprises a rigid body provided with at least one threaded or tapped tubular end crossed transversely and at least in part by a wire-passing opening which is elongate in shape parallel to the longitudinal axis of said tubular end and whose width corresponds to a maximum diameter wire to be connected. The terminal also includes a stopper having a central pusher and screwable onto the end of said tubular end, thereby closing said end; the central pusher moving into the tubular end progressively as the stopper is tightened.

The terminal may also include at least one conductive spike having perforating end points projecting from a common wall, each point passing through the bottom of a wire-passing opening in one of the tubular ends for the purpose of enabling said spike to interconnect respective wires fixed in each end against the common wall within a tubular end into which the wire under consideration is engaged and in which it is fixed by a stopper whose central pusher arrives, when the stopper is screwed home, close to a perforating point with which said stopper is in alignment, said central pusher causing a wire to be pressed against the perforating point in alignment with the stopper by applying lateral pressure to the wire until said perforating point perforates the insulation and penetrates to come into contact with the central conductor stands of the wire.

BRIEF DESCRIPTION OF THE DRAWINGS

An embodiment of the invention is described by way of example with reference to the accompanying drawings, in which.

MORE DETAILED DESCRIPTION

Figure 1:
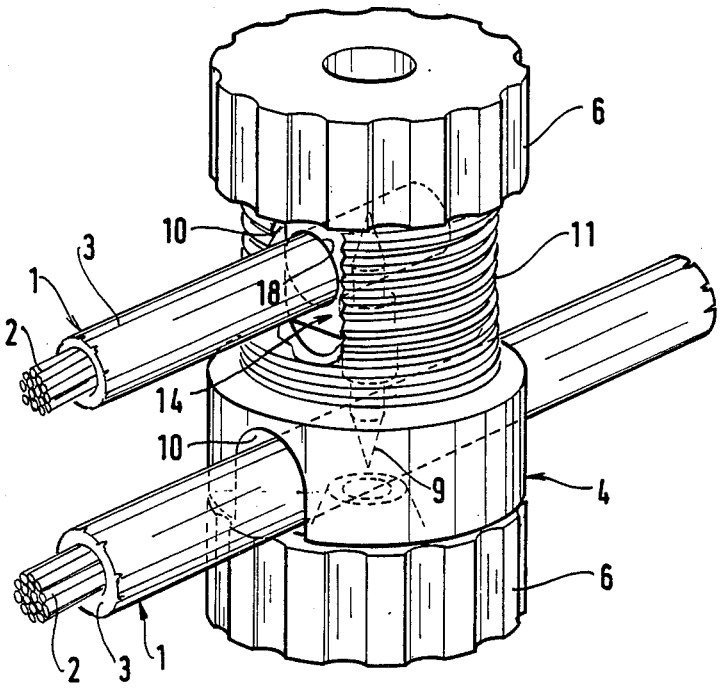
FIG. 1 shows an example of an electric connection terminal in accordance with the invention mounted on electric wires which it interconnects.

The connection terminal shown in FIG. 1 is intended for interconnecting two electric power transporting wires 1, each being of the type comprising a multi-strand conductor 2 within insulation 3, said wires being interconnected either end-to-end or else as a tap of one on the other, without cutting the wires. The connector comprises a rigid body 2 which may be made of metal but which is preferably made of molded insulating material such as a polyamide. The terminal body 4 has at least two tubular tapped or threaded ends which, in this case, are in alignment with the axis of the body which is itself generally tubular in appearance. It would also be possible to provide tubular ends disposed obliquely relative to each other or in parallel on a common support. In the example described, the terminal body 4 includes an annular portion of increased thickness 5 in the middle thereof, said portion of increased thickness serving to fix the body in a complementary hole through a support wall (not shown) by clamping said wall between the portion of increased thickness and a nut (not shown) screwed onto the threads of one of the tubular ends.

A stopper 6 is screwed onto each tubular end of the body 4. Each stopper 6 is intended to imprison a wire in the body of the body 4 both of whose tubular ends are provided with elongate wire-passing openings 7 disposed along the longitudinal axis of the tubular ends, i.e. in this case along the axis of the tubular body 4.

In this case, the wire-passing openings 7 of the tubular ends are separated by a common base wall 8 having an at least partially conducting spike 9 received therethrough, said spike projecting in the form of a wire-perforating point into each of the wire-passing openings and being fixed, for example, as a force fit or by overmolding.

When the tubular ends are not in alignment along a common longitudinal axis, the spike 9 may optionally include a multiplicity of branches, and is bent so as to project from a common wall through the bottoms of the wire-passing openings of each of the tubular ends in question, with such dispositions being easily designed and not shown herein.

The wire-passing openings which open out into the side walls of the tubular ends may optionally be constituted by blind holes, and in the embodiment described they are disposed diametrically and pass right through the tubular ends, opening out at the ends thereof and delimiting respective slots enabling a through wire to be inserted either transversely through the open ends of the slots or radially along the lengths of the slots.

Each wire-passing opening, and consequently in this case each slot, has a width which is a function of the maximum diameter of the wire to be connected and fixed in place, at least in part, by the slots.

In the embodiment described, and in particular for economizing material, the tubular ends are hollow and the maximum diameter wire 1 insertable into a slot is fixed by two identical notches 10 (referenced by their edges in FIG. 4) delimiting said slot. These notches 10 are disposed symmetrically about a longitudinal mid-plane of the body so as to be diametrically opposite and they extend through the wall of each tubular end.

In this case, the spike 9 is rectilinear, is disposed axially, and is fixed in the body 9 with the projecting height of the insulation-piercing point of the spike 9 above the common bottom wall 10 within either of the wire-passing openings (in this case in one or other of the slots) being selected to ensure that the point can pass radially through the insulation 3 of a wire 1 and engage itself between the strands of the central conductor 2 of said wire. The height of this projection is preferably limited so as to avoid the perforating point passing diametrically right through the wire 1 and projecting out through the other side thereof.

A stopper 6 is put into place on a tubular end by being screwed thereon, with the stopped having an outside thread for being received in the tapping of a tubular end (in an embodiment not shown herein) or else having an internal tapping for screwing onto outside threads 11 formed on each tubular end as shown in FIGS. 1 to 4.

Each stopper 6 includes a central pusher 12 penetrating into the tubular end in which it is being screwed so as to move towards the perforation point received in said end progressively as the stopper is tightened, until it is at a distance therefrom corresponding to the thickness of the insulation 3 of the wire 1 which is to be connected in said tubular end.

In this case, the central pusher 12 is hollow and comprises a cylindrical base terminated by a frusto-conical portion for pressing laterally via an annular bearing surface of smaller diameter than the cylindrical base against the wire in the connection position.

A through wire 1 is connected by positioning the wire through the slot of a tubular end after the corresponding stopper 6 has been unscrewed, either partially in order to allow the wire to be inserted between the perforation point and the stopper, providing the stroke of the stopper makes this possible, or else completely so that the wire is inserted bodily sideways into the slot after the stopper has been removed.

This possibility makes it possible to put the terminal into place without stripping or cutting the wire, and the wire may already be positioned in permanent manner.

By tightening the stopper 6 onto the tubular end (after putting it back into place, if necessary), the wire is pressed against the perforation point of the spike. The point presses into the wire through its insulation and comes into contact with the central conductor strands 3, thereby establishing electrical continuity.

In addition, in the embodiment shown, the tubular ends are hollow and two longitudinal wire wedging and guiding ribs 13 are provided per tubular end. The two ribs 13 of a given tubular end are coplanar and are disposed respectively about the mid-plane mentioned above with reference to the notches 10, with which the ribs are parallel. A wire to be connected is guided by the slopes of the ribs tending in a first portion to convey the wire towards the middle of the tubular element over the point. In a second portion, the ribs 13 of a tubular end are parallel to each other where they encompass the perforation point contained in said tubular end, and they are separate from each other by a distance corresponding to the diameter of the wire to be connected so as to center the wire on the point during connection and also so as to engage in holding of the wire in place.

The connection terminal of the invention cna also be used to connect a wire whose diameter is defined by the width of the slot of one tubular end to another wire of smaller diameter by means of a thimble 14 which is inserted in one of the tubular ends around the perforation point of the spike 9, between the bottom wall carrying said spike 9 and the stopper 6 which closes the tubular end in question.

Figure 2:
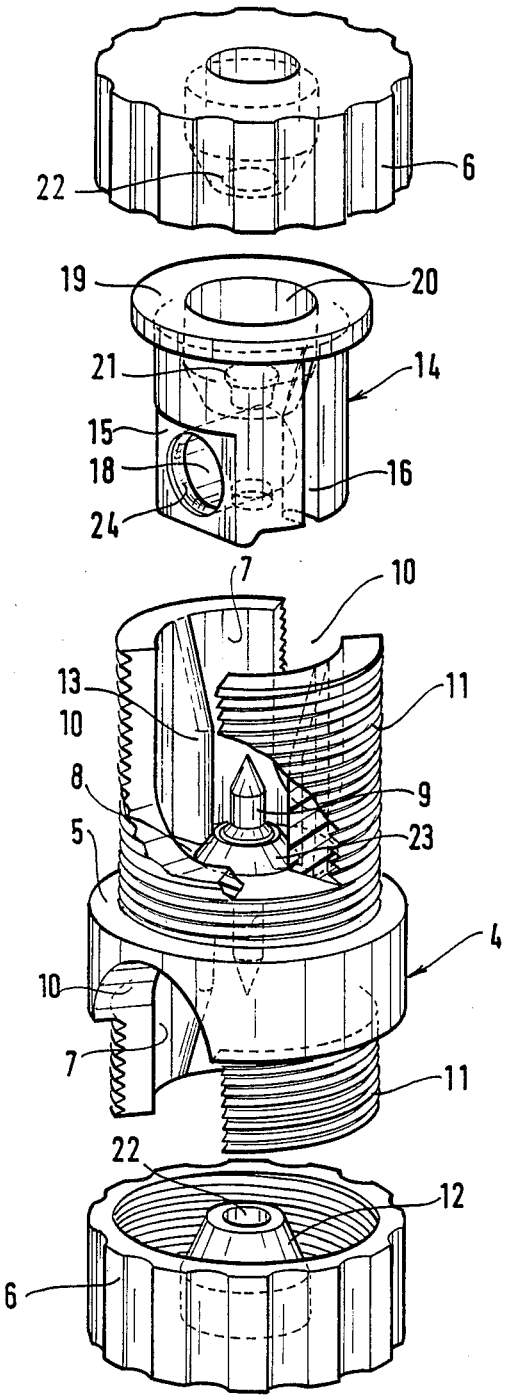
FIG. 2 is an exploded view of the FIG. 1 connection terminal.
Figure 3:
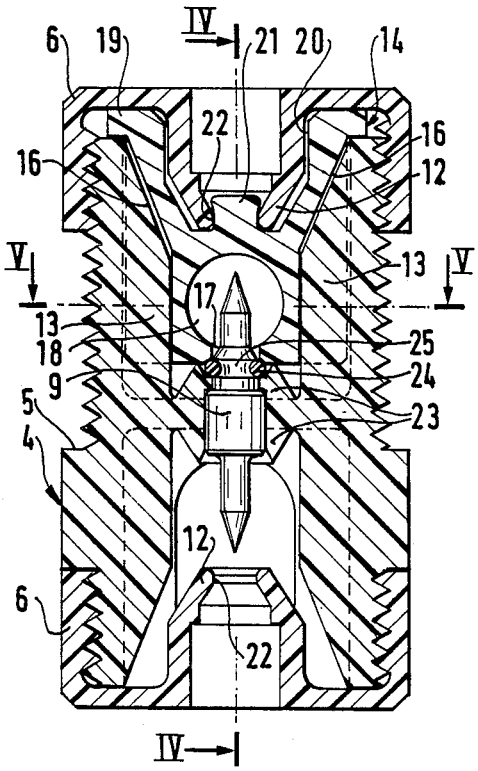
FIGS. 3 and 4 are two longitudinal sections at right angles through the connection terminal in accordance with the invention, respectively on lines III—III and IV—IV.
Figure 4:
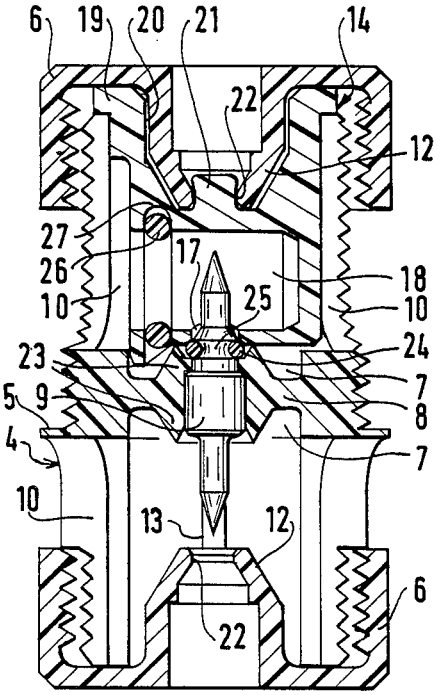
Figure 5:
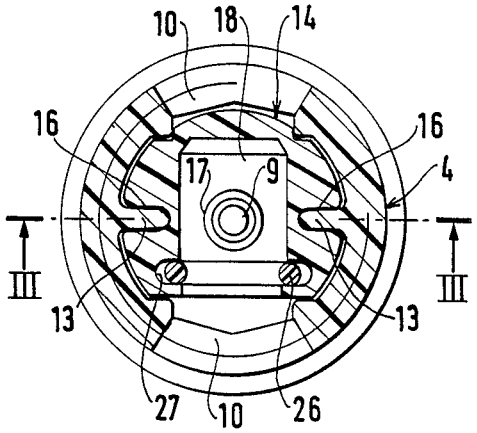
FIG. 5 is a cross-section on line V—V.

The outside shape of the thimble 14 is complementary to the shape of the items mentioned above and within which it is received. The thimble 14 comprises, in this case, a roughly cylindrical body 15 for insertion inside one of the tubular ends via the open end thereof. The sides of the body 15 are provided with two longitudinal grooves 16 complementary to the ribs 13 of one of the tubular ends (FIGS. 2, 4, and 5). These grooves prevent the body 15 from rotating within the tubular end and they guide it in translation.

In the embodiment described, the body 15 is made of molded insulating material, and it is provided with a circular axial orifice 17 for allowing the perforating point of the spike 3 to penetrate into a duct 18 provided transversely near the bottom of the body 15 close to the orifice 17.

The transverse duct 18 which may go right through the body but which is shown as being a blind hole in this case, is intended to hold a wire. It is provided in such a manner as to open facing one of the notches 10 between the edges of the notch, thereby allowing a wire to pass into the duct.

A wire can be made to pass right through a duct if the duct opens out to both of the notches 10 on either side thereof.

The end of the body 15 furthese from the circular orifice 17 is extended in this case by an outwardly projecting annular flange 19 for being inserted between a stopper 6 and the tubular end onto which the stopper is screwed, thereby limiting the depth to which the thimble 14 can be pushed into the tubular end and preventing the thimble from moving in translation when the stopper 6 is fully tightened.

The maximum penetration of the thimble 14 into a tubular end is preferably selected in such a manner as to ensure that the perforation point received in said tubular end projects into the transverse duct 18 of the thimble to a height suitable for passing through the insulation 3 on one side of the wire and through the central conducting strands 2 without projecting through the other side of the wire.

In the embodiment shown, the body 15 also includes an arrangement allowing the thimble 14 to be engaged on the central pusher 12 of the stopper 6.

This engagement arrangement comprises an axial cavity 20 provided in the body 15 opening to the center of the annular flange 19 and capable of receiving the central pusher 12, and to this end it includes a structure whose profile is complementary to that of the pusher, thereby enabling the pressure exerted by the pusher while the stopper is being tightened to be transmitted to the body 15.

A central stud 21 provided in the bottom of the axial cavity 20 causes the thimble to be constrained to move in translation with the stopper 6 when the stopper is removed. In the present embodiment, the central stud 21 is snap-fit in a complementary recess 22 opening out in the end of the central pusher 12 of the stopper.

A first wire 1 of smaller diameter than another wire 1 may be connected therebo by means of a connection terminal in accordance with the invention by initially connecting the larger diameter wire on the side where the spike is received in the common bottom wall 8 when the spike 9 is a force fit. The smaller diameter wire is then inserted in the transverse duct 18 of a thimble 14 fixed to a stopper 6. As the stopper 6 is screwed onto the tubular end of the terminal, the thimble moves down inside said tubular end around the perforating point received therein, and thus causes the point to penetrate transversely into the wire where it comes into contact with the central conductor strands in order to ensure electrical continuity between the wires.

Naturally, two wires both of smaller diameter than the maximum possible diameter may be interconnected using the connection terminal in question by using two thimbles, one for each of the two wires.

In the embodiment described, dampness is prevented from penetrating into the wires firstly by means of annular lips 23 provided on either side of the common bottom wall 8 around the spike 9. These annular lips press against the insulation 3 of a wire all around the spike when the wire is pressed against the bottom of the slot by the stopper 6.

When a thimble 14 is used, the spike 9 should be surrounded by a first O-ring 24 whuch is placed between the bottom wall 8 and the body 15 of the thimble in a circular outer positioning groove 25 provided for said O-ring on the spike.

A second O-ring 26 is also provided close to the opening of the transverse duct 18, in a circular inside groove 27 of the body 15 so as to surround the wire inserted into said duct.

Naturally an O-ring may be provided in each opening of the transverse duct 18 if it opens out to both sides of the body 15 in order to allow a wire to pass right through.

It is also possible to connect more than two wires together by means of a terminal whose body comprises as many tubular ends as there are wires to be connected, with each tubular end including a perforating point of a spike which is electrically connected to the perforating points of the other tubular ends.

We claim:

1. An electrical connection terminal for power transport wires each constituted by a multi-strand conductor within insulation, said terminal comprising a rigid body provided with at least one threaded or tapped tubular end crossed transversely and at least in part by a wire-passing opening which is elongate in shape parallel to the longitudinal axis of said tubular end and whose width corresponds to a maximum diameter wire to be connected, together with a stopper including a central pusher and screwable onto the end of said tubular end, thereby closing said end, the central pusher moving into the tubular end progressively as the stopper is tightened, said terminal also including at least one conductive spike having perforating end point projecting from a common wall, each point passing through the bottom of a wire-passing opening in one of the tubular ends for the purpose of enabling said spike to interconnect respective wires fixed in each end against the common wall within a tubular end into which the wire under consideration is engaged and in which it is fixed by a stopper whose central pusher arrives, when the stopper is screwed home, close to a perforating point with which said stopper is in alignment, said central pusher causing a wire to be pressed against the perforating point in alignment with the stopper by applying lateral pressure to the wire until said perforating point perforates the insulation and penetrates to come into contact with the central conductors strands of the wire, said terminal further comprising:

two tubular ends respectively provided on opposite sides of the common bottom wall with said tubular ends including respective wire-passing openings, said spike projecting on opposite sides of said common bottom wall into said openings and being situated on the alignment axis of said tubular ends, a body provided with at least one hollow tubular end whose wire-passing opening is delimited by two diametrically opposite longitudinal notches disposed symmetrically about a longitudinal mid-plane through said end, and further including a body provided with at least one tubular end having an outer thread which is provided on its inside with two diametrically opposite ribs disposed symmetrically about a longitudinal mid-plane perpendicular to the longitudinal mid-plane about which the longitudinal notches are symmetrical, said ribs serving in a first portion to center a wire to be connected relative to the perforating point of the spike which is disposed between them, and participating in a second portion in wedging said wire engaged on said perforating point.

2. An electrical connection terminal for power transport wires each constituted by a multi-strand conductor within insulation, said terminal comprising a rigid body provided with at least one threaded or tapped tubular end crossed transversely and at least in part by a wire-passing opening which is elongate in shape parallel to the longitudinal axis of said tubular end and whose width corresponds to a maximum diameter wire to be connected, together with a stopper including a central pusher and screwable onto the end of said tubular end, thereby closing said end, the central pusher moving into the tubular end progressively as the stopper is tightened, said terminal also including at least one conductive spike having perforating end point projecting from a common wall, each point passing through the bottom of a wire-passing opening in one of the tubular ends for the purpose of enabling said spike to interconnect respective wires fixed in each end against the common wall within a tubular end into which the wire under consideration is engaged and in which it is fixed by a stopper whose central pusher arrives, when the stopper is screwed home, close to a perforating point with which said stopper is in alignment, said central pusher causing a wire to be pressed against the perforating point in alignment with the stopper by applying lateral pressure to the wire until said perforating point perforates the insulation and penetrates to come into contact with the central conductors strands of the wire, said terminal further comprising:

a thimble whose body is suitable for being inserted into a tubular end via the open end thereof, said thimble body being provided with a transverse wire-holding duct which opens out at at least one of its ends level with one of the wire-passing openings of said tubular end, together with a circular orifice at the bottom of the body for enabling the perforating end of the spike to penetrate transversely into the wire holding duct in order to engage in a wire under pressure from the stopper as it is tightened onto the tubular end and presses against the body via its central pusher pressing towards the common bottom wall from which the perforating end of the spike projects.

3. An electrical connection terminal according to claim 1, including at least one arrangement for guiding a thimble in translation within a tubular end, and an arrangement for limiting the extent to which the thimble penetrates into the tubular end.

4. An electrical connection terminal according to claim 1, including a translation guide arrangement constituted by longitudinal grooves of the thimble disposed to engage with the internal ribs of the tubular end.

5. An electrical connection terminal according to claim 2, including an insertion limiting arrangement constituted by an outwardly projecting annular element provided at the end of the body of the thimble furthest from the end having the circular orifice, said annular element bearing against the end of the tubular end and being fixed against said end by the stopper when the stopper is screwed tight.

6. An electrical connection terminal for power transport wires each constituted by a multi-strand conductor within insulation, said terminal comprising a rigid body provided with at least one threaded or tapped tubular end crossed transversely and at least in part by a wire-passing opening which is elongate in shape parallel to the longitudinal axis of said tubular end and whose width corresponds to a maximum diameter wire to be connected, together with a stopper including a central pusher and screwable onto the end of said tubular end, thereby closing said end, the central pusher moving into the tubular end progressively as the stopper is tightened, said terminal also including at least one conductive spike having perforating end point projecting from a common wall, each point passing through the bottom of a wire-passing opening in one of the tubular ends for the purpose of enabling said spike to interconnect respective wires fixed in each end against the common wall within a tubular end into which the wire under consideration is engaged and in which it is fixed by a stopper whose central pusher arrives, when the stopper is screwed home, close to a perforating point with which said stopper is in alignment, said central pusher causing a wire to be pressed against the perforating point in alignment with the stopper by applying lateral pressure to the wire until said perforating point perforates the insulation and penetrates to come into contact with the central conductors strands of the wire, said terminal further comprising:

a body whose common bottom wall includes at least one annular sealing lip provided around a perforating point of the spike so as press against the insulation of a wire connected by being engaged on said perforating point.

7. An electrical connection terminal according to claim 1, including at least a first O-ring surrounding the perforating end of a spike projecting from the common bottom wall, said first O-ring being held in a groove in the spike between the bottom wall and the body of the thimble, together with at least one second O-ring placed in an internal circular groove of the wire-holding duct at the opening to said duct, thereby surrounding a wire inserted in said duct in sealed manner.

* * * * *